US010926915B2

(12) United States Patent
Ritzberger

(10) Patent No.: US 10,926,915 B2
(45) Date of Patent: Feb. 23, 2021

(54) COLLAPSIBLE CONTAINER

(71) Applicant: Georg Utz Holding AG, Bremgarten (CH)

(72) Inventor: Axel Ritzberger, Altendorf (CH)

(73) Assignee: Georg Utz Holding AG, Bremgarten (CH)

( * ) Notice: Subject to any disclaimer, the term of this patent is extended or adjusted under 35 U.S.C. 154(b) by 37 days.

(21) Appl. No.: 16/345,607

(22) PCT Filed: Oct. 27, 2017

(86) PCT No.: PCT/EP2017/077590
§ 371 (c)(1),
(2) Date: Apr. 26, 2019

(87) PCT Pub. No.: WO2018/078088
PCT Pub. Date: May 3, 2018

(65) Prior Publication Data

US 2019/0291920 A1 Sep. 26, 2019

(30) Foreign Application Priority Data

Oct. 28, 2016 (DE) ..... 20 2016 106 088.5

(51) Int. Cl.
*B65D 6/18* (2006.01)
*B65D 21/02* (2006.01)
*B65D 85/36* (2006.01)

(52) U.S. Cl.
CPC ..... *B65D 11/1833* (2013.01); *B65D 21/0209* (2013.01); *B65D 21/0213* (2013.01); *B65D 85/36* (2013.01)

(58) Field of Classification Search
CPC ..... B65D 11/1833; B65D 21/0209; B65D 21/0213; B65D 85/36
USPC ..... 220/4.28–8; 206/600, 515, 517
See application file for complete search history.

(56) References Cited

U.S. PATENT DOCUMENTS 5,398,834 A 3/1995 Umiker
5,515,987 A 5/1996 Jacques et al.
5,588,549 A * 12/1996 Furtner ..... B65D 11/1833 220/7
6,209,741 B1 * 4/2001 Boucher-Giles ... B65D 11/1833 220/4.28

(Continued)

FOREIGN PATENT DOCUMENTS

CN 1076661 A 9/1993
WO 00/29294 A2 5/2000

(Continued)

OTHER PUBLICATIONS

International Search Report of PCT/EP2017/077590, dated Feb. 23, 2018.

*Primary Examiner* — Chun Hoi Cheung
*Assistant Examiner* — Brijesh V. Patel
(74) *Attorney, Agent, or Firm* — Collard & Roe, P.C.

(57) ABSTRACT

A collapsible container includes a bottom and longitudinal and transverse side walls rising up from this bottom and is designed so as to be foldable in the direction of the bottom, wherein at least one of the side walls can additionally be folded outwards in such a way that its inner side wall surface, which lies at the top in this position, and the surface of the bottom form a common plane.

9 Claims, 10 Drawing Sheets

(56) References Cited

U.S. PATENT DOCUMENTS

Figure 1:
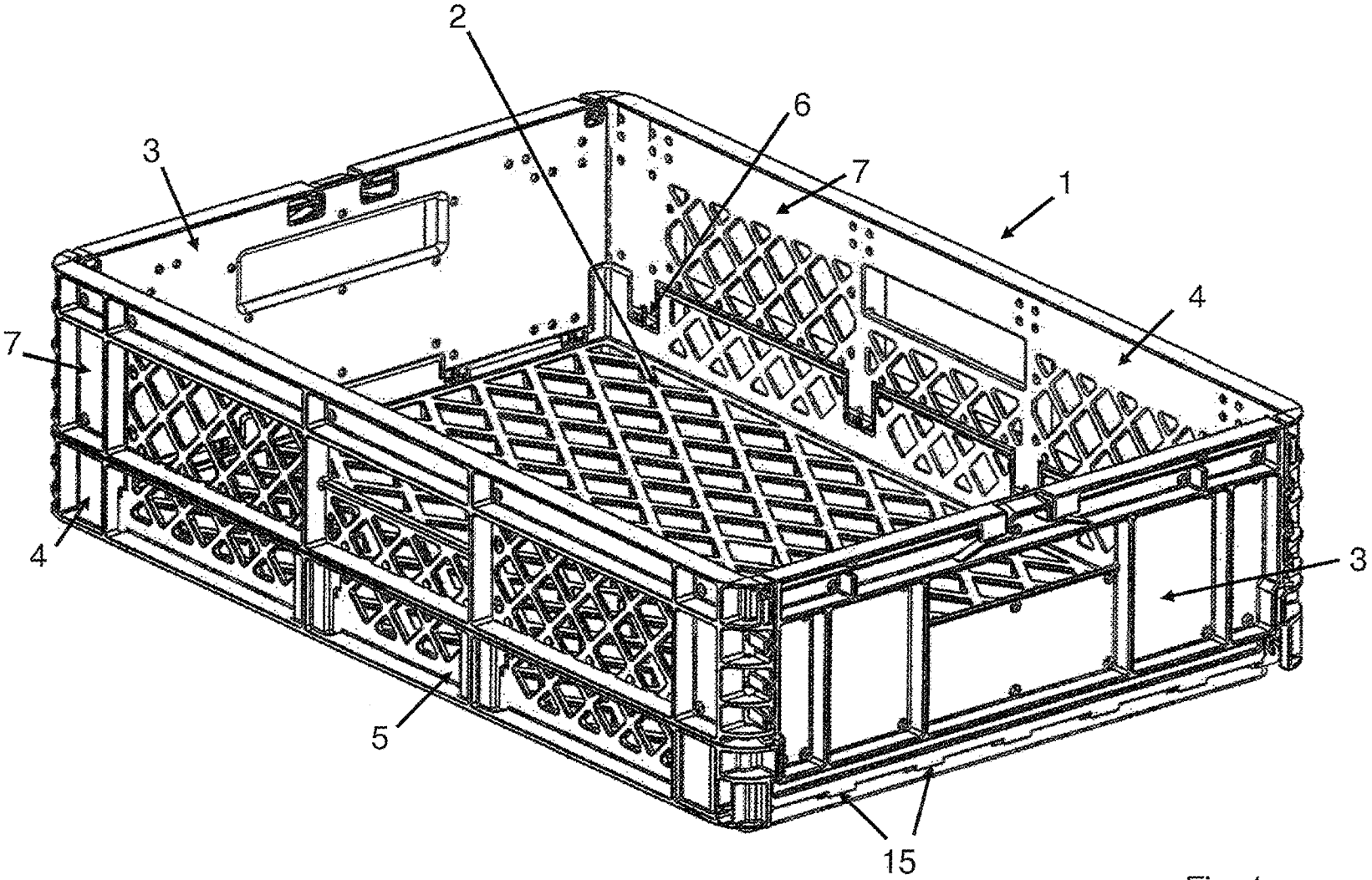

| | | | | |
|---|---|---|---|---|
| 6,631,822 | B1 * | 10/2003 | Overholt | B65D 11/1833 220/7 |
| 6,708,836 | B2 | 3/2004 | Zelko | |
| 6,820,761 | B1 * | 11/2004 | Mouri | B65D 11/1833 206/600 |
| 6,843,386 | B2 * | 1/2005 | Raghunathan | B65D 11/1833 220/7 |
| 7,017,766 | B2 * | 3/2006 | Hsu | B65D 11/1833 220/6 |
| 7,044,319 | B2 * | 5/2006 | Overholt | B65D 11/1833 220/7 |
| 7,086,555 | B2 * | 8/2006 | Overholt | B65D 11/1833 220/6 |
| 7,104,414 | B2 * | 9/2006 | Apps | B65D 11/1833 220/6 |
| 7,264,122 | B2 * | 9/2007 | Koefelda | B65D 11/1833 206/600 |
| 2009/0101640 | A1 | 4/2009 | Hadar | |
| 2011/0108558 | A1 * | 5/2011 | Magni | B65D 11/20 220/592.01 |
| 2017/0073107 | A1 * | 3/2017 | Nakai | B65D 11/1833 |

FOREIGN PATENT DOCUMENTS

| | | | |
|---|---|---|---|
| WO | 2007/011317 | A1 | 1/2007 |
| WO | 2011/071786 | A2 | 6/2011 |

* cited by examiner

COLLAPSIBLE CONTAINER

CROSS REFERENCE TO RELATED APPLICATIONS

This application is the National Stage of PCT/EP2017/077590 filed on Oct. 27, 2017, which claims priority under 35 U.S.C. § 119 of German Application No. 20 2016 106 088.5 filed on Oct. 28, 2016, the disclosures of which are incorporated by reference. The international application under PCT article 21(2) was not published in English.

The invention relates to a collapsible container consisting of a bottom and longitudinal and transverse side walls projecting upwardly from this bottom, the container being designed so as to be collapsible in the direction of the bottom.

The collapsible container proposed by the invention is intended in particular for holding bakery products, whereby several of the collapsible containers can be stacked next to and on top of each other. When empty, these collapsible containers can be reduced in size to save space for return transportation by folding two opposite side walls inwards onto the bottom, after which the other two side walls are also folded over in the direction of the bottom onto the already collapsed side walls.

It is to be noted in this context that in the filled state and when combined with other collapsible containers it is quite laborious and time-consuming to remove baked goods from a collapsible container that is arranged within the stack arrangement.

It is, therefore, the objective of the invention to create a possibility for the containers to be made accessible from at least one side to enable the goods to be removed when the containers are in a stacked arrangement.

In accordance with the characterizing part of claim 1 the invention achieves this objective by at least one of the side walls being additionally foldable outwards in such a way that its inner side wall surface then is a top surface and, in this way, forms a common plane with the bottom surface.

Due to this arrangement and the fact that the foldable side wall cannot be folded down beyond the plane it forms with bottom surface, it is possible on the one hand that the baked goods, for example, can be conveniently removed and on the other hand that they cannot fall out of the container when the side wall is hinged down.

The at least one side wall that is outwardly foldable is fixed to the bottom by means of hinges, with the hinges being designed in such a way that a folding angle of 180° can be achieved, i.e. that the side wall can be moved from the inwardly folded position via the vertically erected position into the position 90° folded from the vertical.

In the case of an advantageous embodiment of the invention, it is provided that the at least one outwardly hinged side wall in its vertically erected position can be connected to the two adjacent side walls by means of pins which are resiliently prestressed and inserted into corresponding receptacles located in the two adjacent side walls.

Due to their resilient preloading, the pins automatically snap into the corresponding receptacles when the wall is moved up into the vertical position.

With a view to separating the connection, claim 4 provides that the pins form the ends of a shaped part that consists of two webs in alignment with each other and movable in guides in the side wall and a handle part that connects the webs and is movable in the direction perpendicular to the extension of the webs.

This handle part is actuated by pressing and/or pulling, whereby the webs with their pin-shaped ends are moved out of the receptacles in the adjacent side walls.

In accordance with claim 5, the collapsible container is designed in a manner known per se in such a way that the side walls adjacent to the outwardly foldable side wall consist of two parts, in such a way that an upper side wall part can be folded down onto the bottom by means of hinges located on a lower side wall part, with the height of the lower side wall part being appropriately sized to enable the upper side wall parts to come to rest on top of the outwardly foldable side walls when these are hinged down onto the bottom.

In compliance with claim 6, it is provided that either a longitudinal side wall and/or a transverse side wall be designed so as to be capable of folding outwards.

This makes the collapsible container proposed by the present invention even more universally usable, as it is accessible from the transverse side wall and, if so desired, in a corresponding arrangement from the longitudinal side wall.

As per claim 7 it is proposed that two opposing side walls each should be designed so as to be foldable outwardly. In this manner, the inventive collapsible container is accessible both from the front and from the rear side.

In compliance with claim 8, it is provided that the bottom edge, which points downwards and serves as a base, and the upper edge area of the side walls be complementary to one another in such a way that at least two containers can be stacked on top of each other.

As the outwardly foldable side wall must be able to pass through the vertical position without any problems from the outwardly folded position into the inwardly folded position, it is provided in accordance with claim 9 that the at least one outwardly foldable side wall has a plurality of outwardly projecting engagement elements arranged vertically one above the other on its side edges pointing towards the adjacent side walls, which, in the vertical position of the at least one outwardly foldable side wall, are accommodated in appropriately complementary recesses arranged on the abutting edges of the adjacent side walls.

The engagement elements and the corresponding complementary formed out recesses are designed in a comb-like manner, so that the wall can be folded inwards and outwards, but in the vertical position the intermeshing comb-like design ensures the stability of the container and/or the safeguards the connection even in the event transverse forces are exerted.

In order to safeguard—as described above—the horizontal position of the outwardly folded side wall in the plane of the container bottom, it is provided in accordance with claim 10 that at the lower edge of the outwardly foldable side wall a cross-sectionally stepped molding is arranged which interacts with a stop integrally molded on the bottom edge in such a way that in its outwardly folded state the side wall forms a common plane with the bottom.

Figure 2:
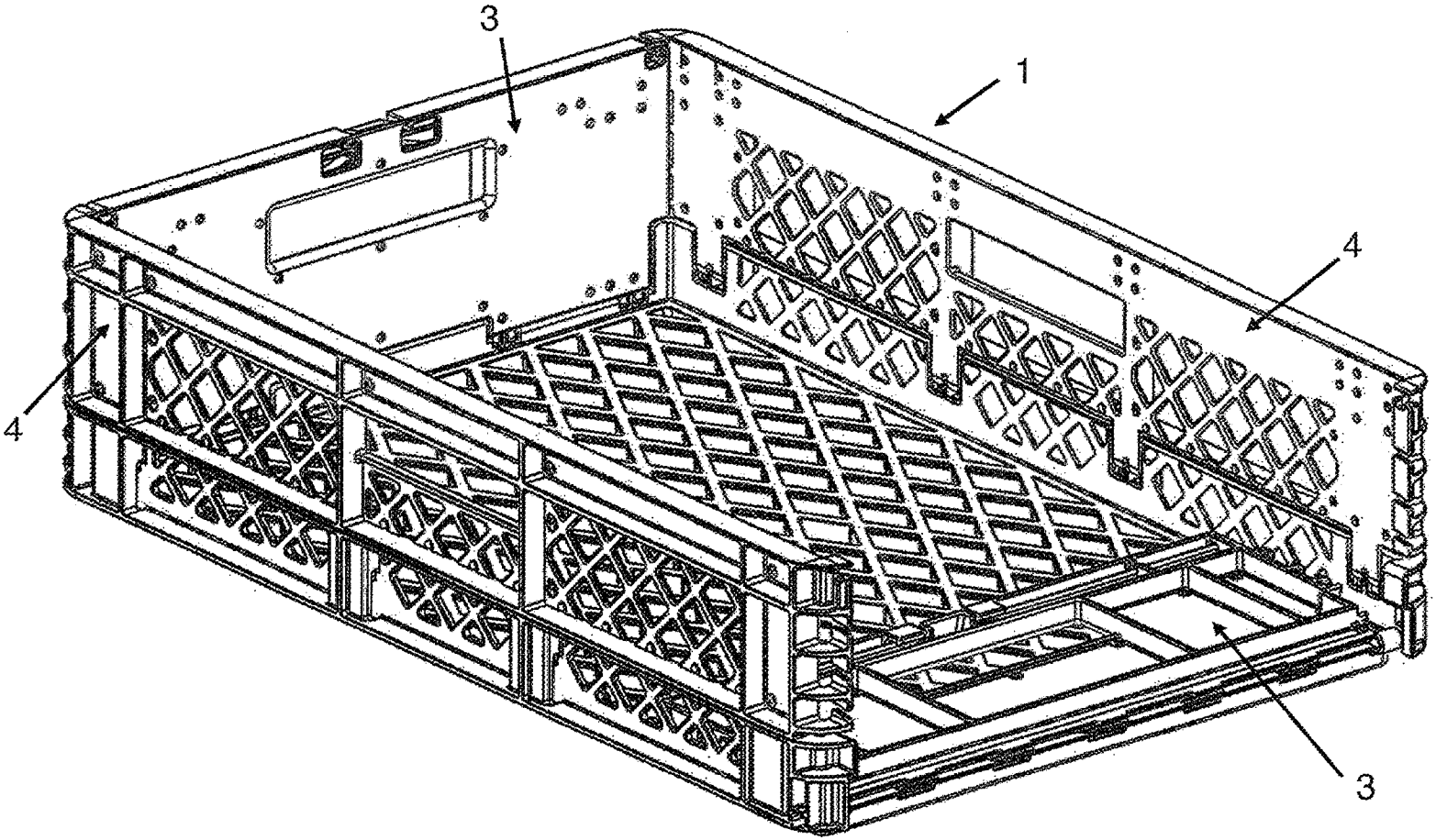
Figure 3:
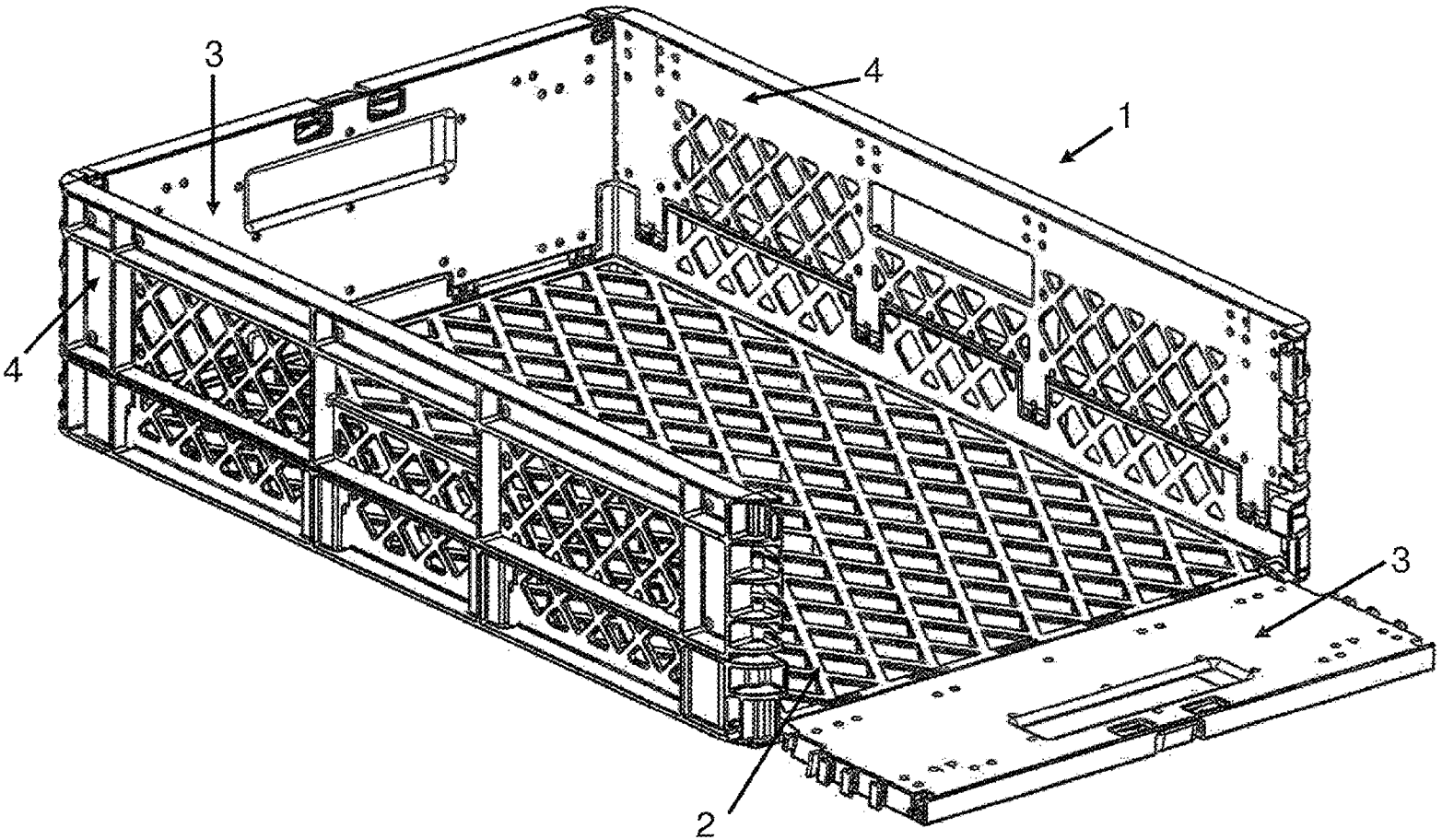
Figure 4:
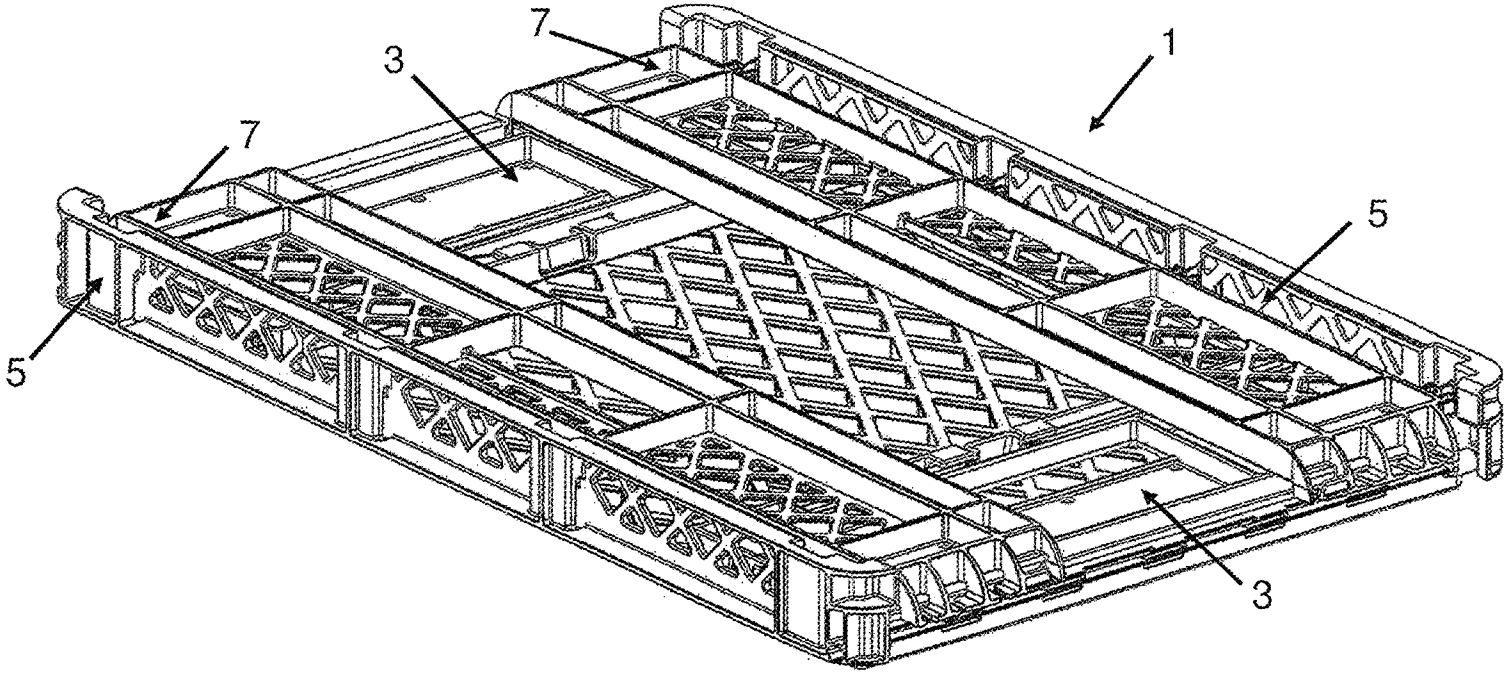
Figure 5:
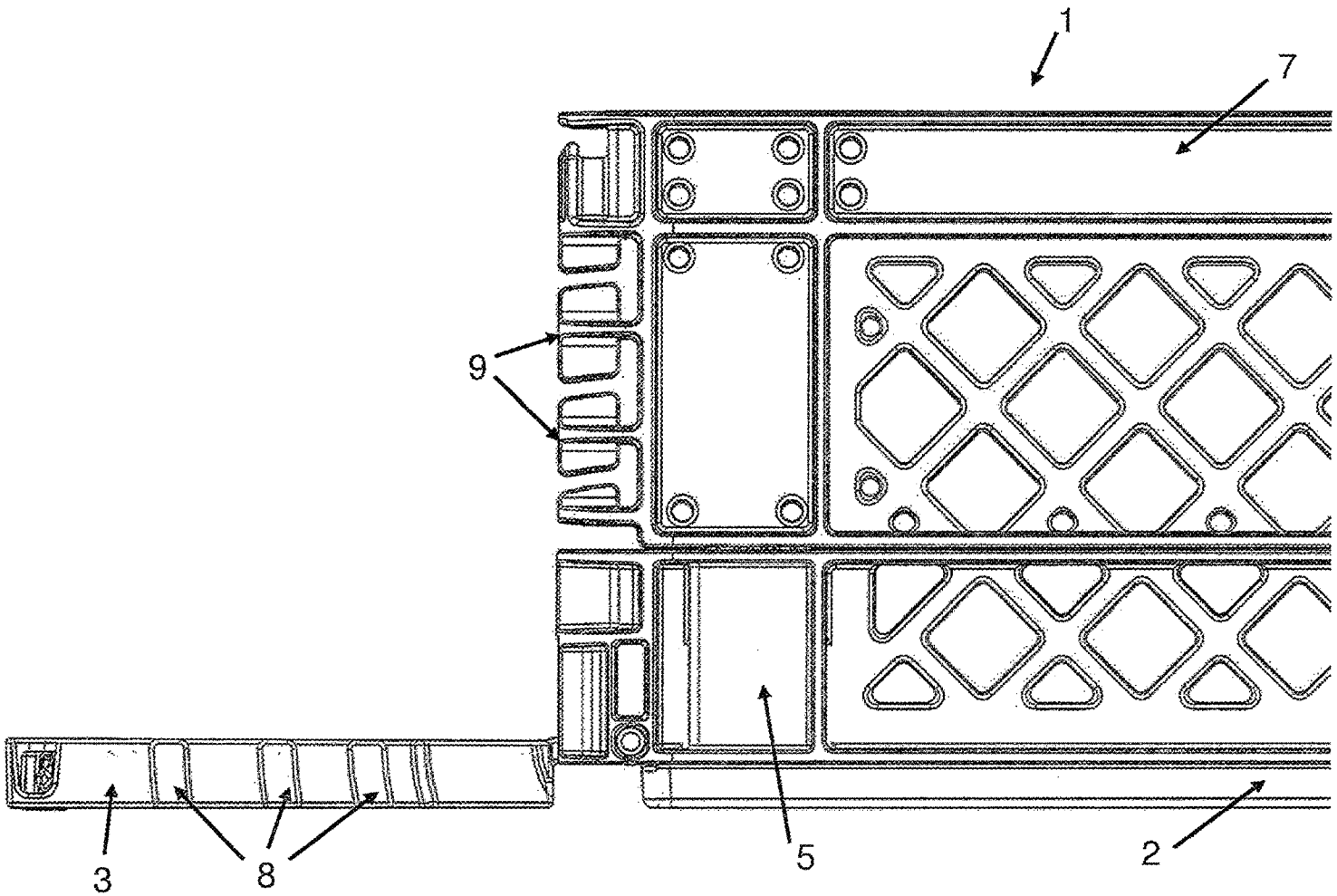
Figure 6:
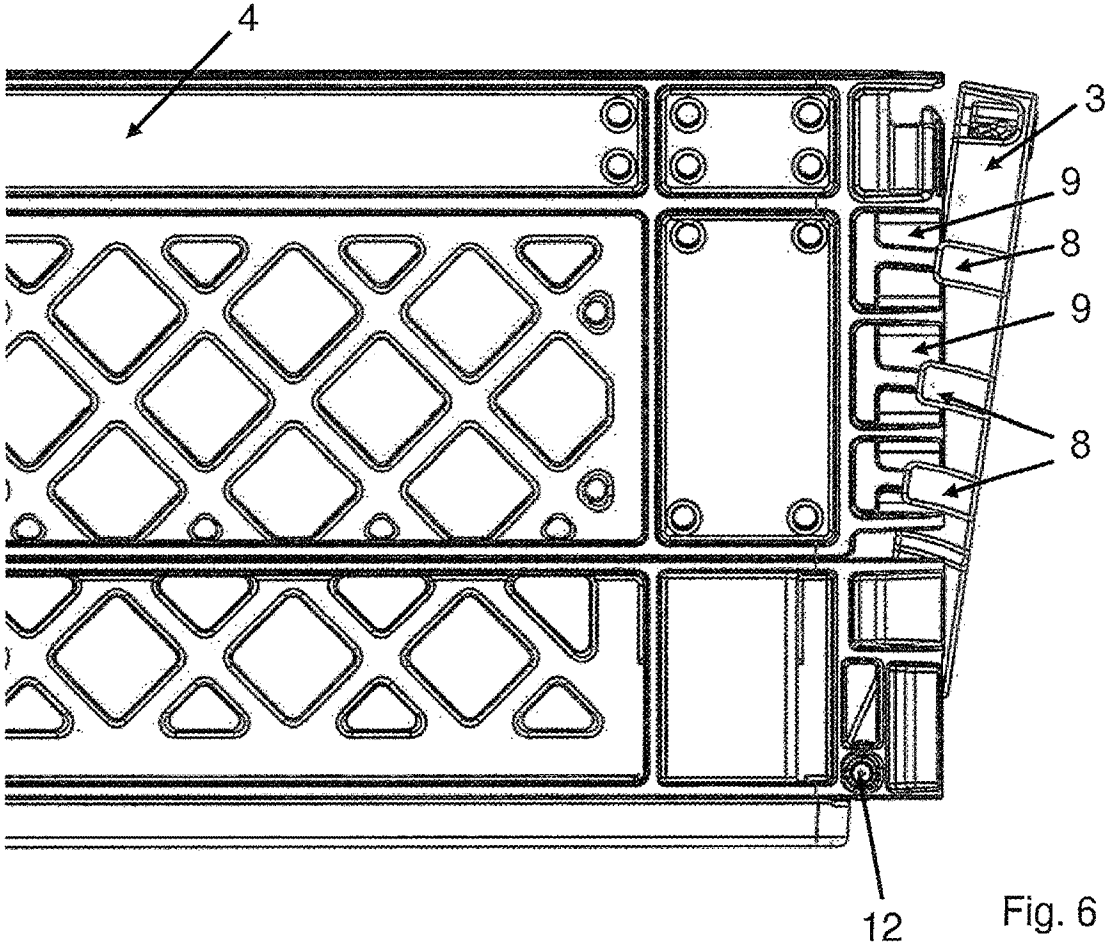
Figure 7:
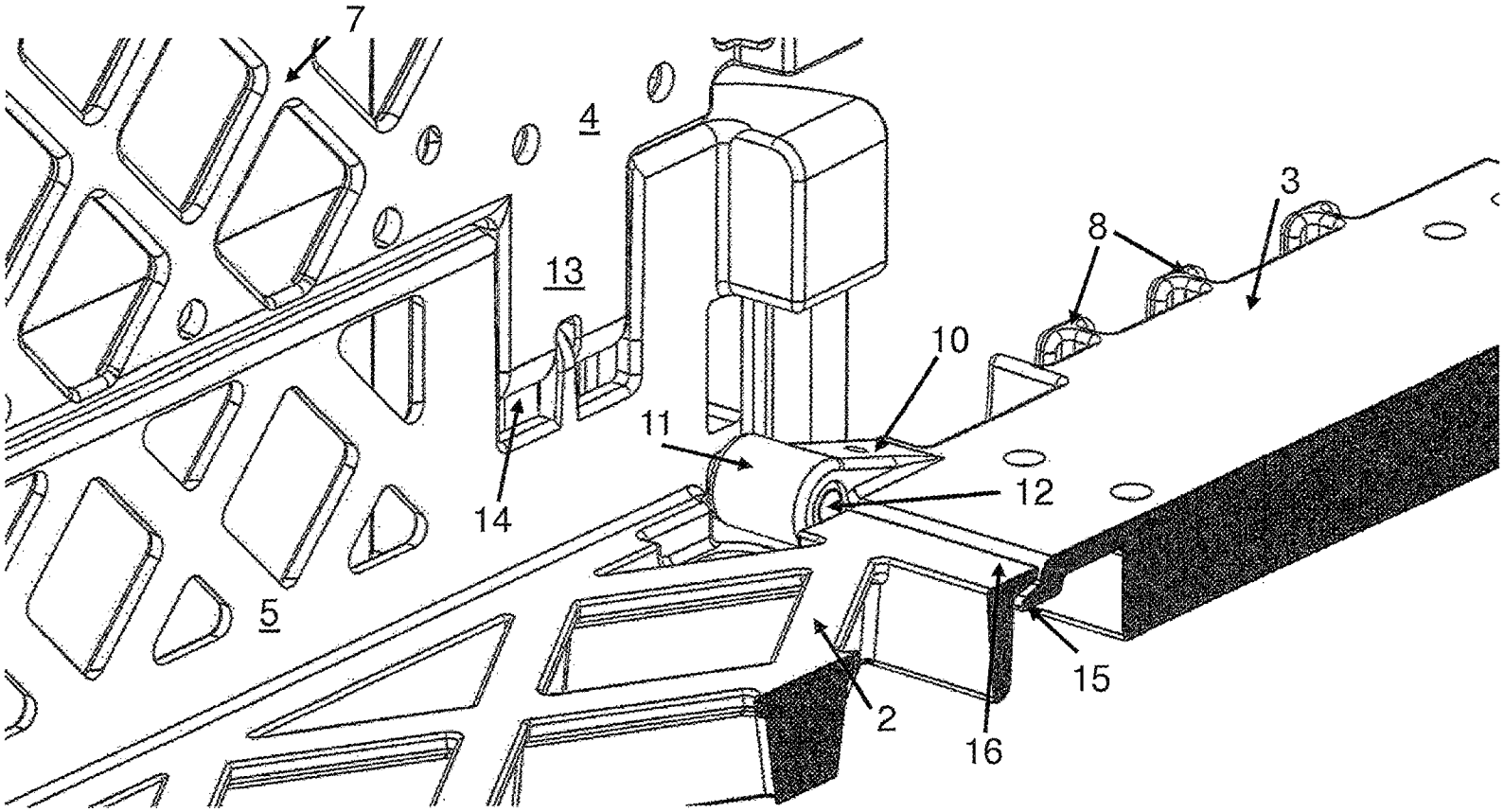
Figure 8:
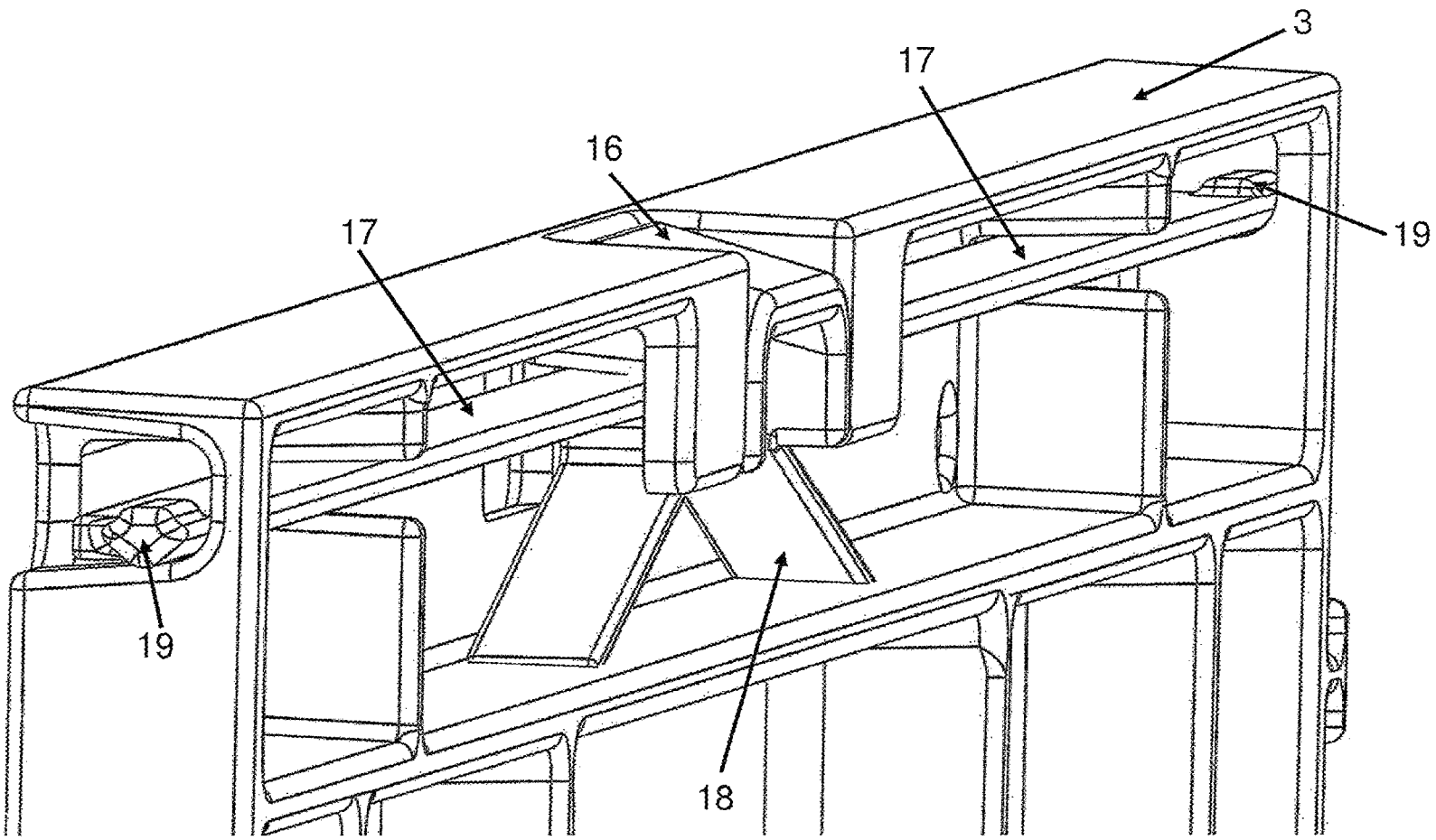
Figure 9:
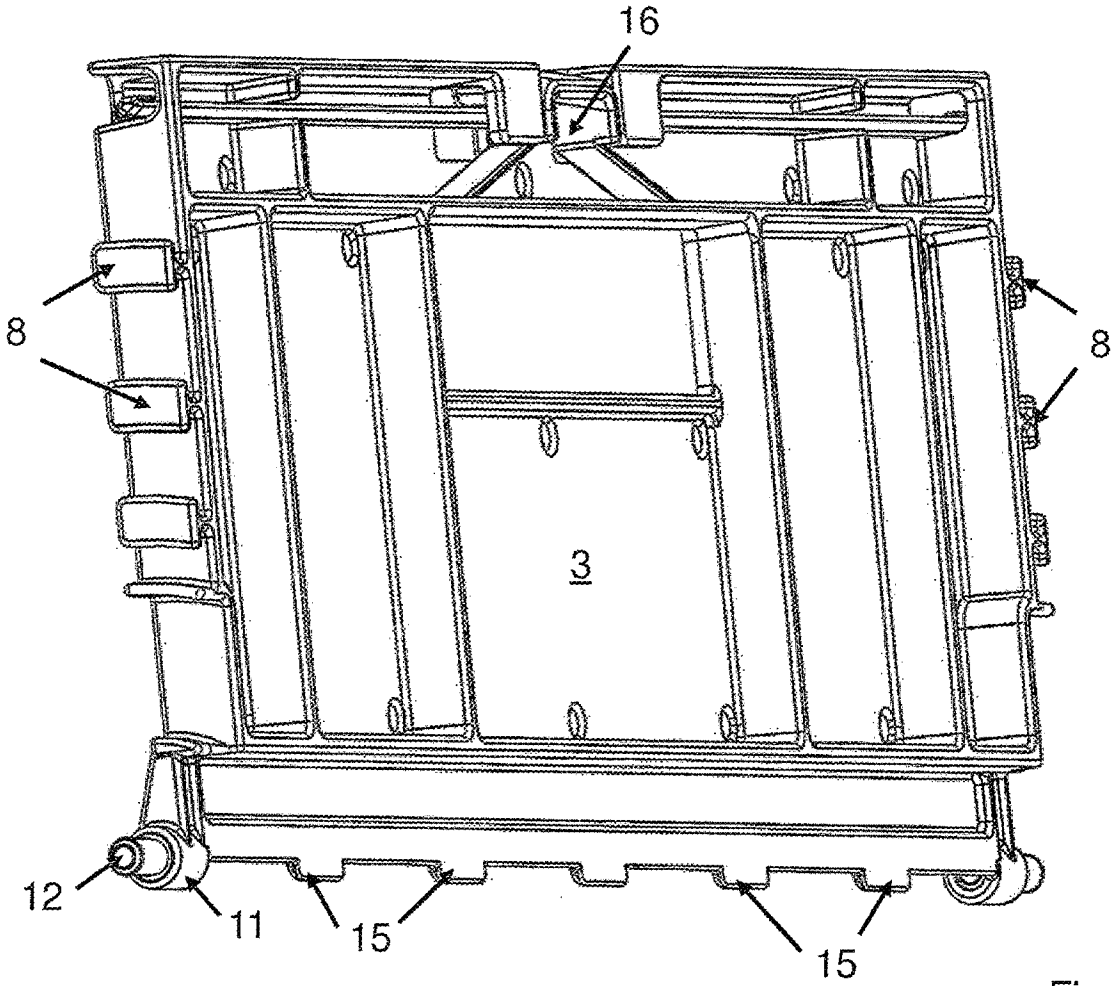
Figure 10:
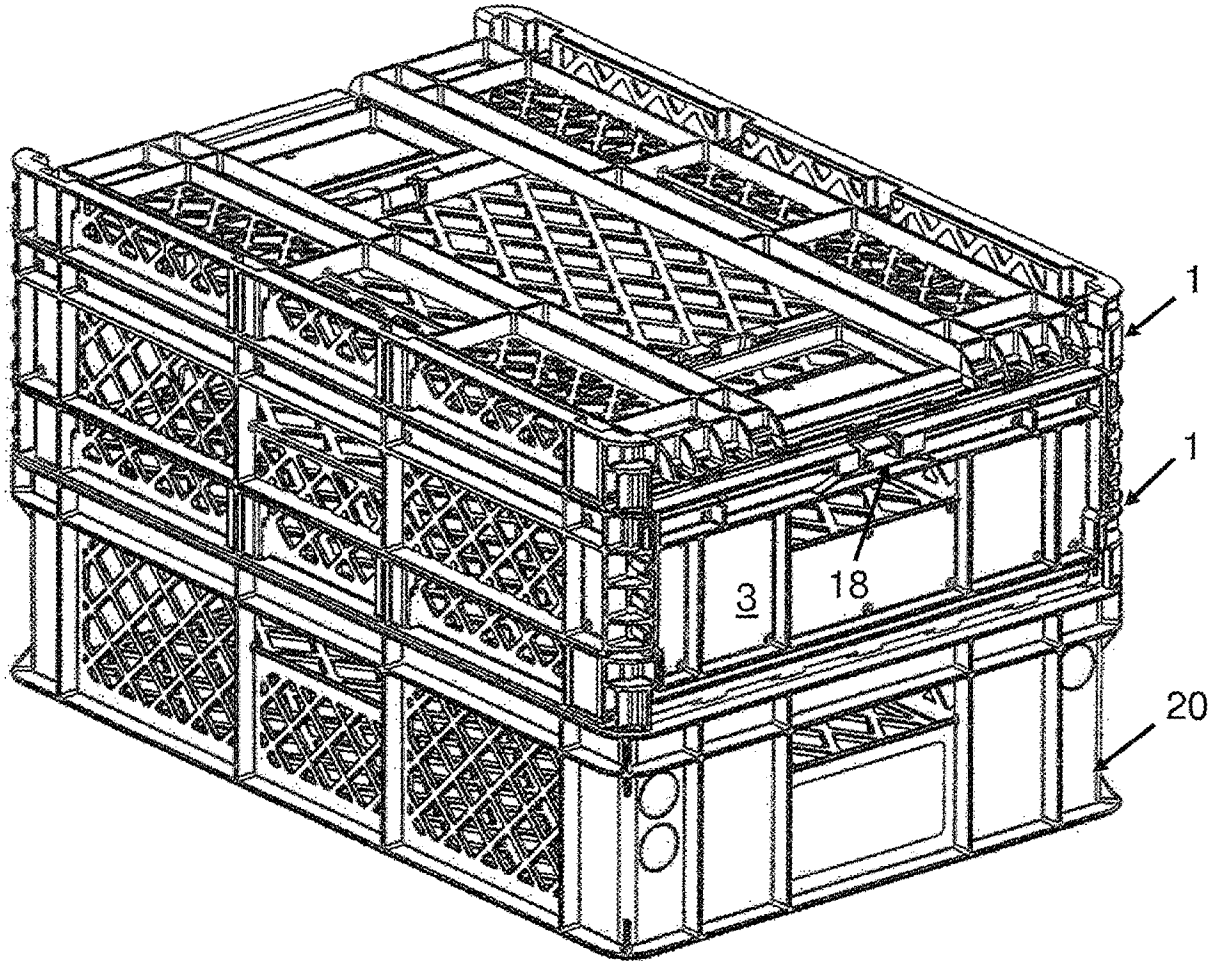

The present invention is elucidated in sufficient detail and depicted by way of the following figures, where FIG. 1: shows the collapsible container in upright position;

FIG. 2: shows the collapsible container with inwardly folded transverse side wall;

FIG. 3: depicts the collapsible container with outwardly folded transverse side wall;

FIG. 4: shows the collapsible container in collapsed state;

FIG. 5: is a partial side view of the collapsible container with side wall folded outwards;

FIG. 6: is a partial side view of the collapsible container just before the outwardly foldable side wall has reached its vertical position;

FIG. 7: is a detailed view of the hinge area of the outwardly foldable side wall;

FIG. 8: shows a detailed view of the locking and unlocking device of the outwardly foldable side wall;

FIG. 9: shows the outwardly foldable side wall in perspective representation;

FIG. 10: shows a stacking option of several folding containers placed on top of each other on a non-collapsible container.

FIG. 1 shows a collapsible container in upright position for which the reference numeral 1 is used in general. The collapsible container 1 consists of a bottom part 2, two transverse side walls 3 and two longitudinal side walls 4. The transverse side walls 3 are made in one piece, while the longitudinal side walls 4 consist of an area 5 fixed to the bottom 2 and an area 7 that can be folded around hinges 6.

As can be seen from FIGS. 2 and 3, at least one of the side walls, in the present case side wall 3, can be folded both inwards onto the bottom 2 and outwards into a position in which the inner surface of this side wall 3 together with the bottom 2 span over a common plane. FIG. 4 illustrates how the collapsible container 1 can be brought into its collapsed position. For this purpose, as can be seen from FIG. 2, the side wall 3 is folded inwards onto the bottom, followed by the opposite transverse side wall 3, whereupon the upper side wall areas 7 are folded around the hinges 6 onto the previously folded down transverse side walls 3. In the lateral partial view according to FIG. 5, the side wall 3 is folded outwards by 90° from the vertical. As can be seen more clearly from FIG. 9, T-shaped elements 8 are integrally formed on their side edges pointing towards the adjacent longitudinal side walls 4, said T-shaped elements interact with corresponding elements 9 arranged in a comb-like fashion on the end faces of the longitudinal side walls 4, such that when the side wall 3 is folded down from the position shown in FIG. 5 to the position shown in FIG. 2, it is possible to pass through the vertical position without problems, but in the vertical position a stable connection is achieved between the individual side walls 3 and 4 as a result of the interaction of T-shaped elements 8 and corresponding elements 9.

FIG. 6 shows the situation in which side wall 3 with T-shaped elements 8 is about to be immersed in the arrangement of corresponding elements 9.

In FIG. 7 a section of the hinge area is illustrated in which the bottom 2 is hinged to the side wall 3. The hinge consists of a hinge part 10 arranged on the side wall 3 and a hinge part 11 arranged on the bottom 2, with both hinge parts being movably connected to each other by means of a pin 12.

As can additionally be seen from this FIG. 7, the hinges of the side walls 4 are designed in such a way that the hinge part 13 is mounted on the foldable region 7 in a recess 14 in the lower fixed region 5 of the side wall 4 in such a way that an upper position is reached in the upright position of the upper side wall area 7 (as shown in FIG. 7). When folding down the upper side wall area 7, the hinge part 13 in the recess 14 is moved downwards so that the upper side wall area 7 comes to rest flush on the previously folded down side walls 3.

To make sure that the outwardly foldable side wall 3 cannot be folded down beyond the 90° position, cross sectionally step-like extensions 15 are provided in certain areas at the lower edge of the side wall 3, said extensions interacting with correspondingly shaped stop elements 16 arranged at the bottom end.

In FIG. 8 the upper area of the side wall 3 is illustrated in which there is a locking unit 16 which comprises webs 17 movable in guides and a resiliently mounted handle unit 18 capable of moving these webs in the horizontal direction. At the ends of the webs 17 there are pin-like projections 19 which, when the side wall 3 is in its vertical upright position, engage into corresponding receptacles arranged in the adjacent longitudinal side walls 4. When the handle unit 18 is actuated, the pin-like ends 19 are moved out of the receptacles so that the side wall 3 can either be folded inwards or outwards.

FIG. 10 shows a stack of containers, with the lower one being a rigid container 20, onto which is placed in the upright position a container 1 proposed by the present invention, and onto which is placed another inventive container 1 in the collapsed state.

By actuating the handle arrangement 18, the side wall 3 in this stack can be folded outwards so that it reaches the position in which its inner side creates a common plane with the bottom 2 and is thus accessible from the outside.

The invention claimed is:

1. A collapsible container comprising a bottom and a plurality of side walls, the plurality of side walls comprising a plurality of longitudinal side walls rising up from the bottom and a plurality of transverse side walls rising up from the bottom, wherein the plurality of longitudinal side walls and the plurality of transverse side walls are foldable in a direction of the bottom, wherein at least one of the plurality of side walls comprises an outwardly foldable side wall and is foldable outwards in such a way that an inner side wall surface of the outwardly foldable side wall, which lies at a top in this position, and a surface of the bottom form a common plane, and wherein at a lower edge of the outwardly foldable side wall, a stepped molding is arranged which projects downwardly relative to the outwardly foldable side wall and interacts with a stop element integrally molded on an edge of the bottom and projecting outwardly relative to the bottom in such a way that in an outwardly folded state of the outwardly foldable side wall, the outwardly foldable side wall forms a common plane with the bottom and cannot be folded down beyond the 90° position.

2. The collapsible container according to claim 1, wherein the outwardly foldable side wall is connected to the bottom with hinges, wherein the hinges are configured so that the outwardly foldable side wall is movable through an angle of 180°.

3. The collapsible container according to claim 1, wherein the outwardly foldable side wall in a vertically upright position of the outwardly foldable side wall is connected to two adjacent side walls of the plurality of side walls with pins which are resiliently prestressed and engage into corresponding receptacles located in the two adjacent side walls.

4. The collapsible container according to claim 3, wherein the pins comprise ends of a shaped part, the shaped part comprising a plurality of webs in alignment with each other and movable in guides in the two adjacent side walls and a handle part connecting the plurality of webs, wherein the handle part is movable in a direction perpendicular to an extension of the plurality of webs.

5. The collapsible container according to claim 1, wherein two of the plurality of side walls are adjacent to the outwardly foldable side wall, and each of the two of the plurality of side walls comprises two parts, the two parts comprising an upper side wall part and a lower side wall part, wherein the upper side wall part is foldable down onto the bottom via hinges located on the respective lower side wall part, wherein a height of the lower side wall part is appropriately sized to enable the respective upper side wall part to come to rest on top of the outwardly foldable side wall when the respective upper side wall part is folded down onto the bottom.

6. The collapsible container according to claim 1, wherein the outwardly foldable side wall comprises at least one of the plurality of longitudinal side walls and the plurality of the plurality of transverse side walls.

7. The collapsible container according to claim 1, wherein the at least one of the plurality of side walls comprising the outwardly foldable side wall comprises two opposite side walls of the plurality of side walls.

8. The collapsible container according to claim 1, wherein a bottom edge, which points downwards and serves as a base, and an upper edge area of the plurality of side walls are complementary to one another in such a way that at least two collapsible containers are stackable on top of each other.

9. The collapsible container according to claim 1, wherein the outwardly foldable side wall has a plurality of outwardly projecting engagement elements which are arranged vertically one above the other on side edges of the outwardly foldable side wall directed towards adjacent side walls of the plurality of side walls and which, in a vertical position of the foldable side wall, are accommodated in correspondingly complementary recesses arranged on respective end faces of the adjacent side walls.

* * * * *